US007543410B2

(12) United States Patent
Baczewski et al.

(10) Patent No.: US 7,543,410 B2
(45) Date of Patent: Jun. 9, 2009

(54) PNEUMATICALLY OPERATED SYSTEM FOR CONTROLLING DOOR OPERATIONS

(75) Inventors: Gary L. Baczewski, 21430 Forrest Waters Cir., Garden Ridge, TX (US) 78266; Frank Dillingham, Boerne, TX (US)

(73) Assignee: Gary L. Baczewski, San Antonio, TX (US)

( * ) Notice: Subject to any disclaimer, the term of this patent is extended or adjusted under 35 U.S.C. 154(b) by 402 days.

(21) Appl. No.: 10/930,658

(22) Filed: Aug. 31, 2004

(65) Prior Publication Data

US 2006/0042165 A1 Mar. 2, 2006

(51) Int. Cl.
*E05F 11/00* (2006.01)

(52) U.S. Cl. ..... 49/324; 49/199

(58) Field of Classification Search ..... 49/197, 49/198, 199, 200, 201, 26, 27, 28, 138, 339, 49/341, 324, 360; 60/542; 91/31, 355, 356, 91/407

See application file for complete search history.

(56) References Cited

U.S. PATENT DOCUMENTS 3,921,335 A * 11/1975 Hewitt et al. ..... 49/265
3,938,282 A * 2/1976 Goyal ..... 49/137
3,948,000 A * 4/1976 Pedersen ..... 49/340
4,094,158 A * 6/1978 LeVere et al. ..... 49/199
4,476,678 A * 10/1984 Hall ..... 49/26
4,620,828 A * 11/1986 Lemke ..... 49/199
4,624,076 A * 11/1986 Schoeman ..... 49/199
4,765,093 A * 8/1988 Edwards, Jr. ..... 49/197
4,891,908 A * 1/1990 Aquilina ..... 49/199
4,921,009 A * 5/1990 Adam ..... 137/557
5,937,579 A * 8/1999 Baczewski et al. ..... 49/28
6,138,412 A * 10/2000 Rieckmann et al. ..... 49/349
6,385,910 B1 * 5/2002 Smink et al. ..... 49/120
7,118,472 B2 * 10/2006 Kennedy et al. ..... 454/169

* cited by examiner

*Primary Examiner*—Gregory J. Strimbu
(74) *Attorney, Agent, or Firm*—Christopher L. Makay

(57) ABSTRACT

A simplified pneumatic door control system provides door control operations for opening, closing, stopping and reversing a door. The door control system includes as control inputs a gas source, a pneumatic motor, a first pilot valve, and pressurized manual check valves. The pressurized manually opened check valves may be used to remotely activate the control system. The control system further includes a second pilot valve, limit triggers, and a braking system. A reversing function of the control system provides the ability to reverse the direction of the door should the door encounter an obstruction upon closing. A second embodiment provides a hold to open control scheme, wherein the door travels only while a pressurized check valve is vented. Corresponding methods for controlling the door are also provided.

24 Claims, 3 Drawing Sheets

PNEUMATICALLY OPERATED SYSTEM FOR CONTROLLING DOOR OPERATIONS

BACKGROUND OF THE INVENTION

1. Field of the Invention

The present invention relates to door openers, and more particularly, but not by way of limitation, to a door opener having a gas-powered control system.

2. Description of the Related Art

Environmental concerns have created a demand for motor vehicles powered by a fuel other than gasoline. One such alternative fuel for motor vehicles is natural gas. However, natural gas is a safety hazard because it forms a highly explosive mixture with air. In an enclosed structure, such as a garage, this mixture is susceptible to ignition. Therefore, it is highly desirable to eliminate ignition sources in enclosed structures to prevent the mixture from exploding.

In garages, ignition sources include electric garage door openers, which may spark, thereby igniting flammable gases in the air. One solution to eliminate this ignition source requires using a garage door opener with an explosion proof motor. However, due to their cost, many garage owners cannot afford such a motor.

Another solution replaces the electric door motor with a pneumatic door motor. One such door opener design is disclosed in U.S. Pat. No. 4,891,908, issued Jan. 9, 1990, to Aquilina. Aquilina uses a door opener with a pneumatic motor, however, electrical components stop or reverse the door if objects jam underneath the door during closing.

Another door opener with a pneumatic motor is disclosed in U.S. Pat. No. 4,417,418, issued Nov. 29, 1983, to Warning. The Warning motor includes two pistons that are housed within respective cylinders and moved by pressurized air to raise and lower the door. A back pressure within the cylinders slows the door at the end of its travel during opening and closing. Nevertheless, an electrical system controls the operation of the garage door.

Still another pneumatic door opener is disclosed in U.S. Pat. No. 3,921,335, issued Nov. 25, 1975, to Hewitt et al. The pneumatic door opener has a pneumatic control scheme that activates a back pressure that slows the door's opening and closing. A pneumatic sensing means opens a valve that releases back pressure depending upon the position of the door. However, the disclosed pneumatic control fails to stop and reverse the door if the door encounters an obstruction during closing.

Still yet another pneumatic door opener is disclosed in U.S. Pat. No. 5,937,579, issued Aug. 17, 1999, to Baczewski, et al. Baczewski, et al. provides a pneumatic door opener with a reversing and stopping function, however, a less complicated and more cost effective design would be desirable.

Accordingly, a simple and more cost effective pneumatic door opener having a pneumatic control system with door stopping and reversing capabilities improves operability and safety over conventional pneumatic door openers.

SUMMARY OF THE INVENTION

In accordance with the present invention, a simplified pneumatic control system provides door control operations for opening, closing, stopping and reversing a door. The door control system includes a gas source, a pneumatic motor, a first pilot valve interposed between the gas source and the motor, and pressurized manual check valves as control inputs. The control system further includes a second pilot valve and limit triggers to stop the door travel at a desired limit point, a braking system and a manual override function for manual movement of the door. The reversing function activates when an obstruction in encountered while the door is closing. Additionally, provisions are provided for pressurized leading edge buttons and remote activation of the control system.

A second embodiment includes a biasing return in the first pilot valve to force the system into a hold to open and hold to close arrangement. In this embodiment, the door only travels while a pilot valve is vented. This embodiment further includes a manual override function. Use of this type of arrangement reduces the complexity of the system and further provides for remote activation.

Associated methods for controlling the door are also provided.

It is therefore an object of the present invention to provide a simplified constantly pressurized pneumatic door control system.

It is a further object of the present invention to provide a hold to open pneumatic control system.

It is still further an object of the present invention to provide a remotely activated pneumatic control system.

It is still yet further an object of the present invention to provide a pneumatic control system that includes a leading edge function.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTIONS OF THE DRAWINGS

DETAILED DESCRIPTION OF THE PREFERRED EMBODIMENTS

Figure 1:
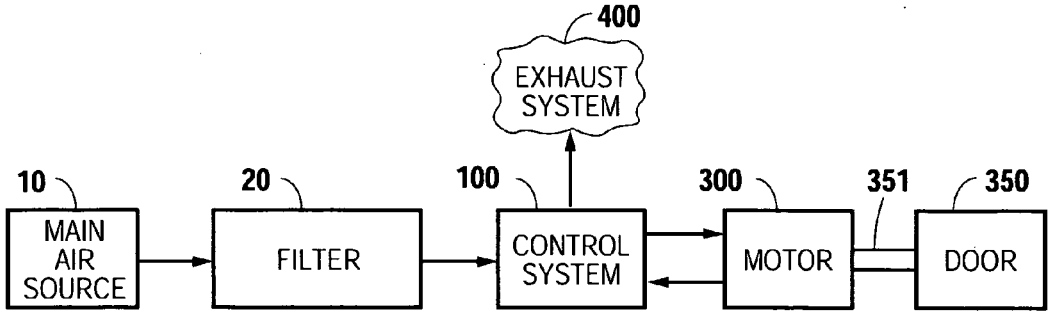
FIG. 1 is a block diagram illustrating the main components of a pneumatic door opener of the present invention.
Figure 2:
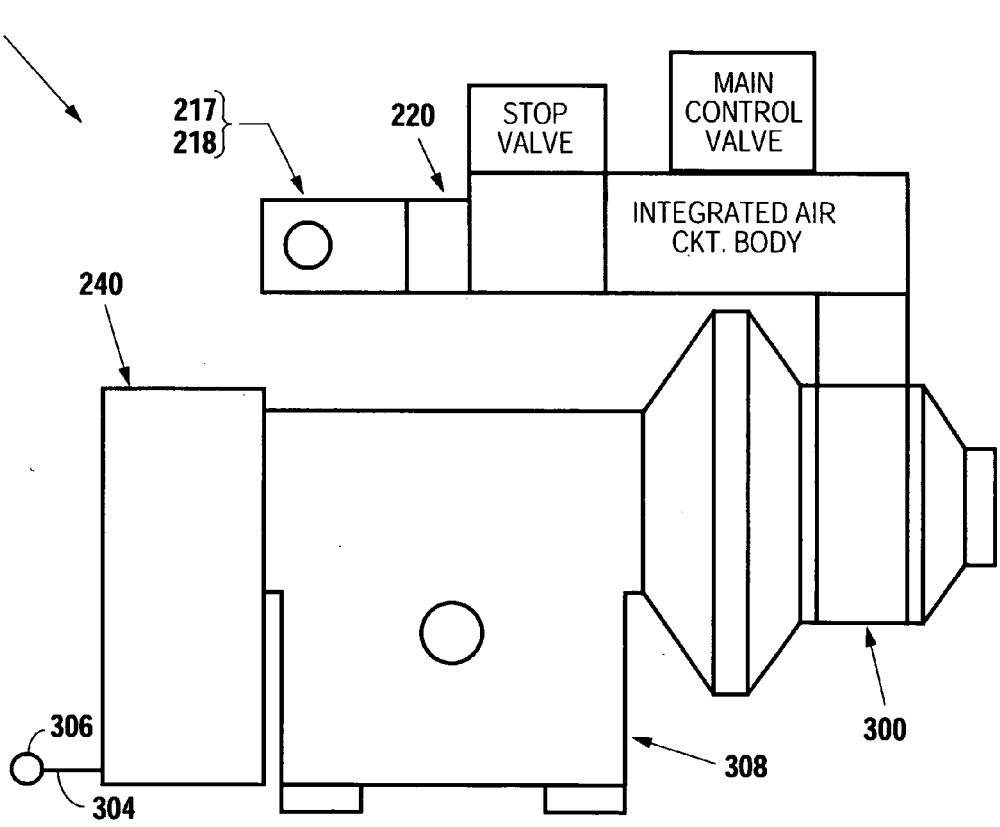
FIG. 2 is a diagram illustrating the components of the pneumatic door opener.
Figure 3:
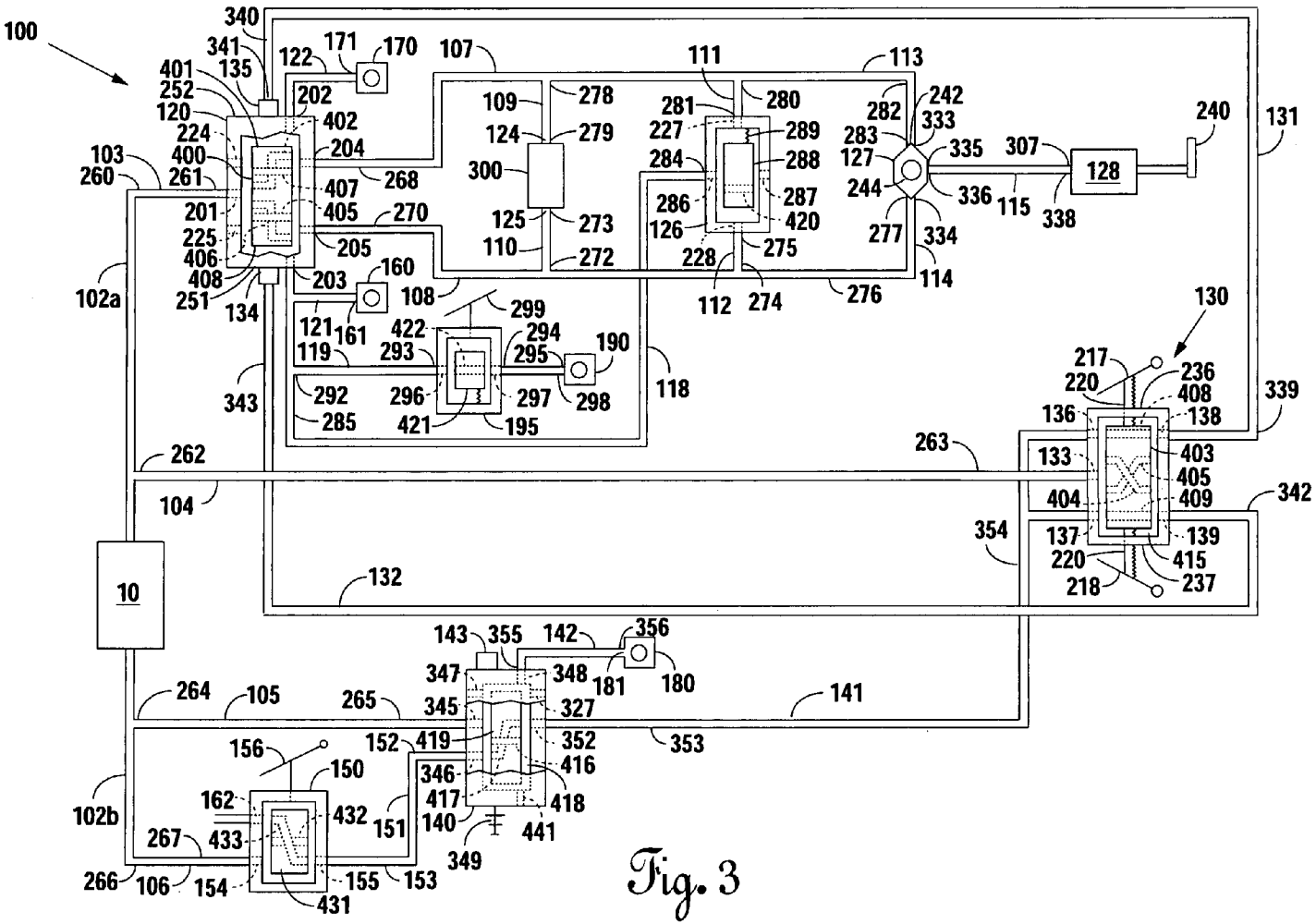
FIG. 3 is a block diagram illustrating a control system of the pneumatic door opener according to the preferred embodiment.

As illustrated in FIGS. 1-3, a pneumatic door opener 5 includes a filter-regulator-lubricator 20, a control system 100, and a motor 300. A first or main air source 10 supplies air that passes through the filter 20 en route to the control system 100. Although in this preferred embodiment one air source 10 is utilized, multiple air sources may be used. Furthermore, gases other than air may be used. The filter-regulator-lubricator 20 filters the air, regulates the pressure, and adds oil that lubricates the valves of the control system 100. The filter-regulator-lubricator 20 removes particles and moisture that may cause the valves of the control system 100 to stick. The air enters the control system 100 to initiate and then control door operation by powering the motor 300, which opens, closes and reverses the direction of the door.

As shown in FIG. 2, the pneumatic door opener 5 includes a motor 300, a gearbox 308, a manual override bar 304, a brake 240, an open limit trigger 217, a close limit trigger 218, and the control system 100. The air from the main air source 10 enters the motor 300 and turns the vanes that communicate with the gearbox 308. The gearbox 308, in turn, is in communication with the pulley operated overhead door. One of ordinary skill in the art will readily recognize that this connection can be designed for any kind of door. The open limit trigger 217 and the close limit trigger 218 stop the opening and closing of the door at each end of its travel (described herein). The open limit trigger 217 and the close limit trigger 218 may actuate any suitable limit notification device, including a limit lever 220, a pneumatic button, or the like, to terminate a sequence.

The manual override bar 304 includes a handle 306 that terminates communication between the pneumatic door opener 5 and the overhead door, thereby permitting manual door operation. Releasing the handle 306 reestablishes communication between the pneumatic door opener 5 and the door.

The control system 100 includes a first pilot valve 120, a second pilot valve 130, a third pilot valve 140, a fourth pilot valve 126, and a shuttle check valve 127. The pilot valves may be of any suitable manufacturer. The first pilot valve 120 is a two position, double differential pilot valve with no springs. As such, the valve 120 will stay in a shifted position until forcibly returned to a neutral or centered position. The second pilot valve 130 is a two position, double pilot, spring centered, pressure pilot valve. The third pilot valve 140 is a two position, double differential pilot valve without springs. The fourth pilot valve 126 is a pressure pilot valve. The shuttle check valve 127 automatically selects the highest pressure side.

The control system 100 further includes a first return air cylinder 134, a second return air cylinder 135, a brake air cylinder 128, a limiter valve 195, and a cam operated valve 150. The first return air cylinder 134 is coupled to the first pilot valve 120, such that it recenters a piston in the valve 120 from a first position associated with opening of the door. The second return air cylinder 135 is likewise coupled to the first pilot valve 120 to center the piston of the pilot valve 120, thereby going from a second position associated with closing the door to a neutral or centered position. The brake air cylinder 128 is used to release the brake 240 in the gearbox 308 of the motor 300. The limiter valve 195 is used to remove the leading edge control system from the control circuit, thereby allowing the door to close fully. The cam valve 150 is a manually operated valve used to stop the operation of the motor 300.

The control system 100 still further includes an open button 160, a close button 170, a stop button 180, and a leading edge reverse button 190. The buttons are manually opened check valves. In a normal state, the pneumatic control system 100 is pressurized. A continuously pressurized control system 100 allows for multiple activation buttons on a single pilot valve, and remote activation through an extended line. Once a bleeder button is activated, that particular side of a pilot valve is vented, thereby creating a pressure differential within the pilot valve. A piston in the valve then shifts from the higher pressure side to the lower pressure side, thereby aligning passages to alternate pressure lines. The buttons, either remotely or mounted to the pilot valves, are used to activate operations such as opening the door, closing the door, stopping the door, and reversing the direction of the door.

As shown in FIG. 3, the main air source 10 of the control system 100 is connected to lines 102*a* and 102*b*. The line 102*a* branches off to a first end 260 of supply lines 103 and a first end 262 of a line 104. The line 102*b* branches off to a first end 264 of a line 105 and a first end 266 of a line 106. A second end 261 of line 103 is connected to a first inlet port 201 of the first pilot valve 120. The first pilot valve 120 includes the first inlet port 201, a second inlet port 224, a third inlet port 225, a first button port 202, a second button port 203, a first outlet port 204, and a second outlet port 205. The first button port 202 is connected to a line 122 that is, in turn, connected to an inlet port 171 of the close button 170. The buttons may be connected remotely or directly to the button ports. The second button port 203 is connected to a line 121 that is connected to an inlet port 161 of the open button 160, either remotely or directly. Lines 122 and 121 may represent passages within the first pilot valve 120 if the buttons 160 and 170 are directly connected to the first and second button ports 202 and 203 of the first pilot valve 120. The second inlet port 224 and the third inlet port 225 are open to atmosphere. A first end 268 of a line 107 is connected to the first outlet port 204.

Line 107 further branches off into a first end 278 of a line 109, a first end 280 of a line 111 and a first end 282 of a line 113. A first end 270 of a line 108 is connected to the second outlet port 205 and further branches off to a first end 272 of a line 110, a first end 274 of a line 112, and a first end 276 of a line 114.

The first air cylinder 134 is attached to a first end 251 of a valve bore 401 of the first pilot valve 120 such that the piston 400 in the valve 120 is returned from an open position to a neutral position when the first air cylinder 134 is pressurized. Similarly, the second air cylinder 135 is attached to a second end 252 of the valve bore 401 such that the piston 400 of the pilot valve 120 is returned from a close position when the second air cylinder 135 is pressurized. The piston 400 further includes two passages per position. An open or first position includes an "open" passage 402 and a "first exit" passage 405. A close or second position includes a "close" passage 406 and a "second exit" passage 407.

A second end 279 of the line 109 and a second end 273 of the line 110 connect to a first port 124 and a second port 125 of the motor 300, respectively. The first and second ports 124 and 125 are used as both inlets and outlets for gases, depending on the desired direction of rotation of the vanes in the motor 300.

A second end 281 of the line 111 connects to a first chamber port 227 of the fourth pilot valve 126. A second chamber port 228 is connected to a second end 275 of the line 112. The fourth pilot valve 126 further includes an inlet port 286, an outlet port 287, a piston 288, and a spring 289. The inlet port 286 is connected to a first end 284 of a line 118. The outlet port 287 is open to atmosphere. The spring 289 is located adjacent to the piston 288. The piston 288 includes a passage 420. A second end 285 of the line 118 is connected to the open button pressure circuit of the first pilot valve 120.

A second end 283 of the line 113 attaches to a first port 333 of the shuttle check valve 127. A second end 277 of the line 114 attaches to a second port 334 of the shuttle check valve 127. A first end 336 of a line 115 attaches to a third port 335 of the shuttle check valve 127. The shuttle check valve 127 includes a shuttle 244 that moves away from a higher pressure. The line 115 connects the shuttle check valve 127 to the brake air cylinder 128. A second end 307 of the line 115 connects to an inlet port 338 of the brake air cylinder 128. The brake air cylinder 128 is coupled to the brake 240.

Additionally, a limiter valve 195 and a leading edge button 190 also attach to the open button pressure circuit of the first pilot valve 120. In this embodiment, the leading edge button 190 is a remote button connected to the open button pressure circuit. Activation of the leading edge button 190 forces the control system 100 into the door opening sequence. A first end 292 of a line 119 attaches to the open pressure circuit of the first pilot valve 120. A second end 293 connects to an inlet port 296 of the limiter valve 195. An outlet port 297 of the limiter valve 195 connects to a first end 294 of a line 116. A second end 295 of the line 116 connects to an inlet port 298 of the leading edge button 190. The limiter valve 195 further includes a limit cutout 299 and a two position piston 421. The piston 421 further includes a passage 422, such that gas may pass through the piston 422 when the limiter valve 195 is in a first position and not pass through in a second position.

A second end 263 of the line 104 connects to a first inlet port 133 of the second pilot valve 130. The second pilot valve 130 is in communication with the limit lever 220 that is in communication with the close limit trigger 218 and the open limit trigger 217. The second pilot valve 130 includes a second inlet port 136, a third inlet port 137, a first outlet port 138, and a second outlet port 139. The first outlet port 138 is coupled to a first end 339 of a line 131. A second end 340 of the line 131 is coupled to an inlet port 341 of the first return air cylinder 134. The second outlet port 139 is coupled to a first end 342 of a line 132. A second end 343 of the line 132 is coupled to an inlet port 344 of the second return air cylinder 135.

The second pilot valve 130 further includes a bore 415 and a piston 403. The bore 415 includes a first end 236 and a second end 237. The piston includes two sets of passages, "pass through" passages 408 and 409 and "stop" passages 404 and 405.

A second end 265 of the line 105 is coupled to a first inlet port 345 of the third pilot valve 140. The third pilot valve 140 is a two position differential pressure valve without springs. The third pilot valve 140 includes a return air cylinder 143 in alignment with a bore 418, and a mechanical stop 349. The third pilot valve 140 still further includes a piston 419, a second inlet port 346, and a third inlet port 347. The piston 419 includes a "pass through" passage 416 and a "manual" passage 417. The third pilot valve 140 still even further includes a button port 348, a first outlet port 352, a second outlet port 327, and a differential port 441 coupled with the air source 10. A first end 355 of a line 142 is coupled to the button port 348. A second end 356 of the line 142 is coupled to an inlet port 181 of the stop button 180. A first end 353 of a line 141 is coupled to the first outlet port 352 of the third pilot valve 140. A second end 354 of the line 141 is divided into two lines and connected to the second inlet port 136 and the third inlet port 137 of the second pilot valve 130.

A second end 267 of the line 106 is coupled to an inlet port 154 of the cam operated valve 150. A second port 155 of the cam operated valve 150 is coupled to a first end 153 of a line 151. A second end 152 of the line 151 is coupled to the second inlet port 346 of the third pilot valve 140. The cam operated valve 150 further includes an actuator 156 and a piston 431 with an "exhaust" passage 433, a "stop" passage 432 and an outlet port 162. In this preferred embodiment, the actuator 156 is a manually operated handle.

In operation, the control system 100 is continuously pressurized, and is capable of opening the door 350, closing the door 350, reversing the direction of the door 350, and stopping the movement of the door 350. The control system 100 further includes provisions for manually stopping the motor 300 and overriding the leading edge function.

In an equilibrium state, the main air source 10 pressurizes the lines 102*a* and 102*b*, thereby pressurizing the lines 103, 104, 105 and 106. The line 103 terminates at the inlet port 201 of the first pilot valve 120. In a non-biased condition, the piston 400 of the first pilot valve 120 is located in the center of the bore 401. As there are no passages in the center of the piston 400, no air passes through the piston 400 to the outlet ports 204 or 205 and the lines 107 and 108. If the open button 160 is depressed, the first end 408 of the valve bore 401 adjacent to the open button 160 loses pressure due to the venting by the open button 160, and the piston 400 is forced to a first position nearest the open button end of the bore 401 by the pressure differential. In the shifted position, the "open" passage 402 lines up with the inlet port 201 and the first outlet port 204 to allow gas into the line 107. As the line 107 is pressurized, the connected lines 109, 111, and 113 are similarly pressurized.

Gas in the line 113 pressurizes the first side 242 of the shuttle check valve 127, thereby forcing the shuttle 244 to block the second port 334 of the shuttle check valve 127. The shuttle check valve 127 then builds pressure to further increase the flow of gas through the motor 300. As the gas pressure builds in the shuttle check valve 127, gas is able to exit the shuttle check valve 127 through the third port 335, thereby entering line 115 and pressurizing the brake air cylinder 128 used as a brake 240 release. Pressurizing the brake air cylinder 128 releases the brake 240 in the gearbox 308 of the motor 300, so that the motor 300 components are able to rotate when gas flows through the motor 300. The brake 240 is normally spring loaded in the engaged position.

Gas in the line 109 then enters the first port 124 of the motor 300 and forces the vanes to rotate, thereby rotating the motor driveshaft 351 and opening the door 350. The gas passing through the motor 300 then exits the second port 125 of the motor and pressurizes the lines 110 and 108. As the gas fills the line 108, it is forced to exit through the second outlet port 205 of the first pilot valve 120. Gas entering the first pilot valve 120 through the second outlet port 205 then passes through the "first exit" passage 405 of the piston 400 and exits the third inlet port 225 of the first pilot valve 120. As such, the gas passing through the motor 300 is unrestricted and the motor 300 will continue to open the door 350 until the opening limit trigger 217 is activated.

Once the door 350 fully opens, the open limit trigger 217 depresses the limit lever 220, thereby moving the piston 403 in the second pilot valve 130 out of a non-biased position. Normally, the piston 403 is centered with spring returns, such that no gas is able to pass from the line 104 to the outlet ports 138 and 139. When the limit lever 220 is depressed, the piston 403 is forced from the centered position to a position aligning the inlet port 133 with the "stop" passage. As such, pressurized gas from the line 104 passes through the inlet port 133, through the "stop" passage 404 in the piston 403, and through the outlet port 139 to the line 132. Since the line 132 is connected to the first return air cylinder 134, the first return air cylinder 134 is also pressurized. The first return air cylinder 134 extends to move the piston 400 of the first pilot valve 120 back to a centered position, thereby shutting off the gas flow through the first pilot valve 120. Accordingly, the motor 300 no longer rotates the driveshaft 351 and the door 350 stops opening. The second pilot valve 130 remains in the shifted position as long as the door 350 is at the ends of its travel, however, the piston 400 in the first pilot valve 120 is free to move to close the door 350.

In the equilibrium state, the lines 102*a* and 103 are pressurized by the main air source 10, and the piston 400 is in a non-biased condition, substantially centered in the bore 401 of the first pilot valve 120. As there are no passages in the center of the piston, no gas passes through the piston to the outlet ports 204 and 205 or the lines 107 and 108. If the close button 170 is depressed in this condition, the second end 252 of the valve bore 401 loses pressure due to the venting by the close button 170, and the piston 400 is forced to a second position nearest the second end 252 by the pressure differential. In the shifted position, the "close" passage 406 lines up with the inlet port 201 and the second outlet port 205 to allow gas into the line 108. As the line 108 is pressurized, the connected lines 110, 112, and 114 are also pressurized, thereby forcing the shuttle 244 in the shuttle check valve 127 to block the first port 333, therein pressurizing the line 115 and thus the brake air cylinder 128 to effect the release of the brake 240.

Gas in the line 110 then enters the second port 125 of the motor 300 and forces the vanes to rotate, thereby rotating the motor driveshaft 351 and closing the door 350. The gas passing through the motor 300 then exits the first port 124 and pressurizes the lines 109 and 107. As the gas fills the line 107, it is forced to exit through the first outlet port 204 of the first pilot valve 120. Gas entering through the first pilot valve 120 through the first outlet port 204 then passes through the "second exit" passage 407 of the piston 400 and exits the second inlet port 224 of the first pilot valve 120. As such, the gas passing through the motor 300 is unrestricted and the motor 300 will continue to close the door 350 until the close limit switch 218 is activated.

Once the door 350 fully closes, the close limit trigger 218 depresses the limit lever 220, thereby moving the piston 403 in the second pilot valve 130 out of a non-biased position. Normally, the piston is centered with spring returns, such that no gas is able to pass from the line 104 to the outlet ports 138 and 139. When the limit lever 220 is depressed, the piston 403 is forced from the centered position to a position aligning the inlet port 133 with the "stop" passage 405. As such, pressurized gas from the line 104 passes through the inlet port 133, through the "stop" passage 405 in the piston 403, and through the outlet port 138 to the line 131. Since the line 131 is connected to the second return air cylinder 135, the second return air cylinder 135 is also pressurized. The second return air cylinder 135 extends and moves the piston 400 of the first pilot valve 120 back to a centered position. The flow of gas through the first pilot valve 120 is now shut off. Accordingly, the motor 300 no longer rotates and the door 350 stops closing. The second pilot valve 130 remains in the shifted position as long as the door 350 is at the ends of its travel, however, the piston 400 in the first pilot valve 120 is free to move to open the door 350.

Upon depression of a stop button 180, the control system 100 stops the movement of the door. Normally, the line 105 is constantly pressurized by the main air source 10, and the piston of the third pilot valve 140 resides in a neutral position. In the neutral position, the piston does not allow pressurized gas to pass from the first inlet port 345 to the first outlet port 352, however, it does allow gas to pass from the first outlet port 352 through the piston to the second inlet port 346. The third inlet port 347 and the second outlet port 327 are unused in this preferred embodiment.

When the stop button 180 is depressed, the piston 419 moves toward the stop button 180 due to the pressure differential in the bore 418. Once shifted, the piston 419 allows the pressurized gas to flow from the first inlet port 345 to the first outlet port 352, thereby pressurizing the line 141. Once the line 141 is pressurized, the gas flows into the second and third inlet ports 136 and 137 of the second pilot valve 130, through the "pass through" passages 408 and 409, and into the outlet ports 138 and 139. As such, the lines 131 and 132, and subsequently, the first and second return air cylinders 134 and 135 are pressurized. Once the first and second return air cylinders 134 and 135 are pressurized, the piston 400 of the first pilot valve 120 is centered, therein ceasing gas flow to the motor 300 and stopping the motion of the door. After the motor 300 has stopped, compressed gas is allowed behind the piston in the return air cylinder 143, which causes the return air cylinder 143 to extend. Upon extending, the return air cylinder 143 forces the piston of the third pilot valve 140 to return to a centered position. The stop 349 prevents the piston from moving past the centered position.

The control system 100 further includes a manual override circuit. The manual override circuit allows an operator to manually depress the cam-operated valve 150 to stop the motor 300, and pull a cable to release the brake. This particular segment of the control system is fed off of the line 106. In this preferred embodiment, the line 106 is substantially continuously pressurized by the main air source. However, the cam operated valve 150 does not allow the pressurized air to enter the system in the normal position.

In the normal position, the piston 431 in the cam operated valve 150 is situated such that it allows gas to pass from the second port 155, through the "exhaust" passage 433 to the outlet port 162. As such, the line 151 serves as an exhaust line for the control system 100. When the handle 156 is depressed, the piston 431 is shifted such that the "stop" passage 432 is aligned with the first port 154 and the second port 155, therein pressurizing the lines 151 and 141. The pressurized gas continues through the system, illustratively through the second pilot valve 130 to the lines 131 and 132, and the first and second return air cylinders 134 and 135. As the first and second return air cylinders 134 and 135 are pressurized, the piston of the first pilot valve 120 is returned to the centered position, thereby ceasing the flow of pressurized gas to the motor 300.

At this point, the operator may release the brake 240 by pulling a cable. Once the brake 240 is released, the operator may manually reposition the door. Once manual operations are completed, the handle 156 may be moved to the normal position, and the brake 240 may be reengaged.

The reversing function of the control system 100 reverses the direction of door movement when the door 350 experiences an obstruction in the door's path. The reversing function is controlled by the fourth pilot valve 126. In operation, the pressures experienced in the lines 111 and 112 directly reflect the pressures in the ends of the passage in the fourth pilot valve 126. If the motor 300 is receiving gas from the gas source 10, then there is an imbalance between the two sides of the fourth pilot valve 126. In the normal position, the piston 288 of the fourth pilot valve 126 is situated such that it is free to move in the fourth pilot valve 126. The piston 288 is connected to a biasing mechanism. In this preferred embodiment, the biasing mechanism is a spring 289. In use, the pressure differential must overcome the spring 289 force to move the piston 288 towards the first chamber port 227. This motion is associated with the closing operation.

As the control system 100 conducts a closing operation, gas is pressurizing the lines 108, 110, 112, and 114, thereby creating an imbalance situation in the fourth pilot valve 126. The increased pressure in the line 112 forces the piston in the fourth pilot valve 126 to move toward the first chamber port 227. The distance moved can be ascertained by knowing the spring rate of the spring 289, the area of the piston and the pressure differential between the two sides of the fourth pilot valve 126. Movement to compress the spring 289 is acceptable, however, extreme differential pressures will cause the spring 289 to compress to a point where the "vent" passage 420 in the piston 288 aligns with the outlet port 287. Extreme pressure differentials are experienced when the door encounters an obstruction, as the compressed gas experiences a resistance due to the mechanical resistance experienced by the door. Alignment of the "vent" passage 420 with the inlet port 286 and the outlet port 287 allows the pressure in the line 118 and the open button pressure circuit to drop, thereby activating the open sequence of the control system 100 and reversing the direction of the door 350. The door 350 then reverses direction, and opens as previously described.

The leading edge portion of the control system 100 is designed to sense obstructions under a leading edge of the closing door. The leading edge function requires that leading edge buttons 190 be remotely placed along the leading edge of the door, such that a button 190 would be compressed when an obstruction is encountered. The leading edge buttons 190 are remotely connected to the pressure circuit for the open button 160, generally, the line 121. Should a leading edge button 190 be activated, a low pressure develops in the open button 160 pressure circuit. The low pressure experienced in the open button 160 pressure circuit is enough to cause the piston in the first pilot valve 120 to move and align the "open" passage 402 with the entry port 201 to commence the flow of gas associated with opening the door 350. It should be clear to one skilled in the art that the quantity and placement of the leading edge buttons 190 may vary depending upon door sizes and spacing between the leading edge buttons 190. Further, it should be noted that the leading edge buttons 190 may be fixtured together to form a bar and cover virtually the entire leading edge, thereby minimizing the hardware and expense.

In the normal position, the piston 421 in the limiter valve 195 is aligned such that the passage 422 is connected to the inlet port 296 and the outlet port 297. Under normal operations with the door 350 in a non-closed position, gas is allowed to pass through the limiter valve 195. In this position, the leading edge buttons 190 are pressurized and functional. When a door 350 moving downward engages an obstruction, a leading edge button 190 is depressed. The activation of the leading edge button 190 causes a low pressure in the open button 160 pressure circuit, thereby causing an imbalance in the first pilot valve 120. The piston 400 in the first pilot valve 120 moves to align the "open" passage 402 with the pressurized line 103 to commence the opening of the door 350. The door 350 will reverse direction and open fully.

The leading edge circuit further includes an automatic cutout. The automatic cutout isolates the pressure circuit associated with the leading edge buttons 190. The leading edge buttons 190 are cut out of the pressure circuit at a predetermined closing height, preferably right before the leading edge buttons 190 are activated by the closing of the door 350, to allow for the door 350 to be fully closed without activating the leading edge buttons 190. Upon activation of the limit cutout 299, the piston 421 in the limiter valve 195 is shifted such that the leading edge segment of the control system 100 is disconnected from the rest of the control system 100. Therein, the door 350 may be completely closed without activating the leading edge buttons 190. In the case of damage to the leading edge circuit, the limiter valve 195 may be depressed, and the control system 100 will then hold pressure, thereby ensuring control of the door 350.

Figure 4:
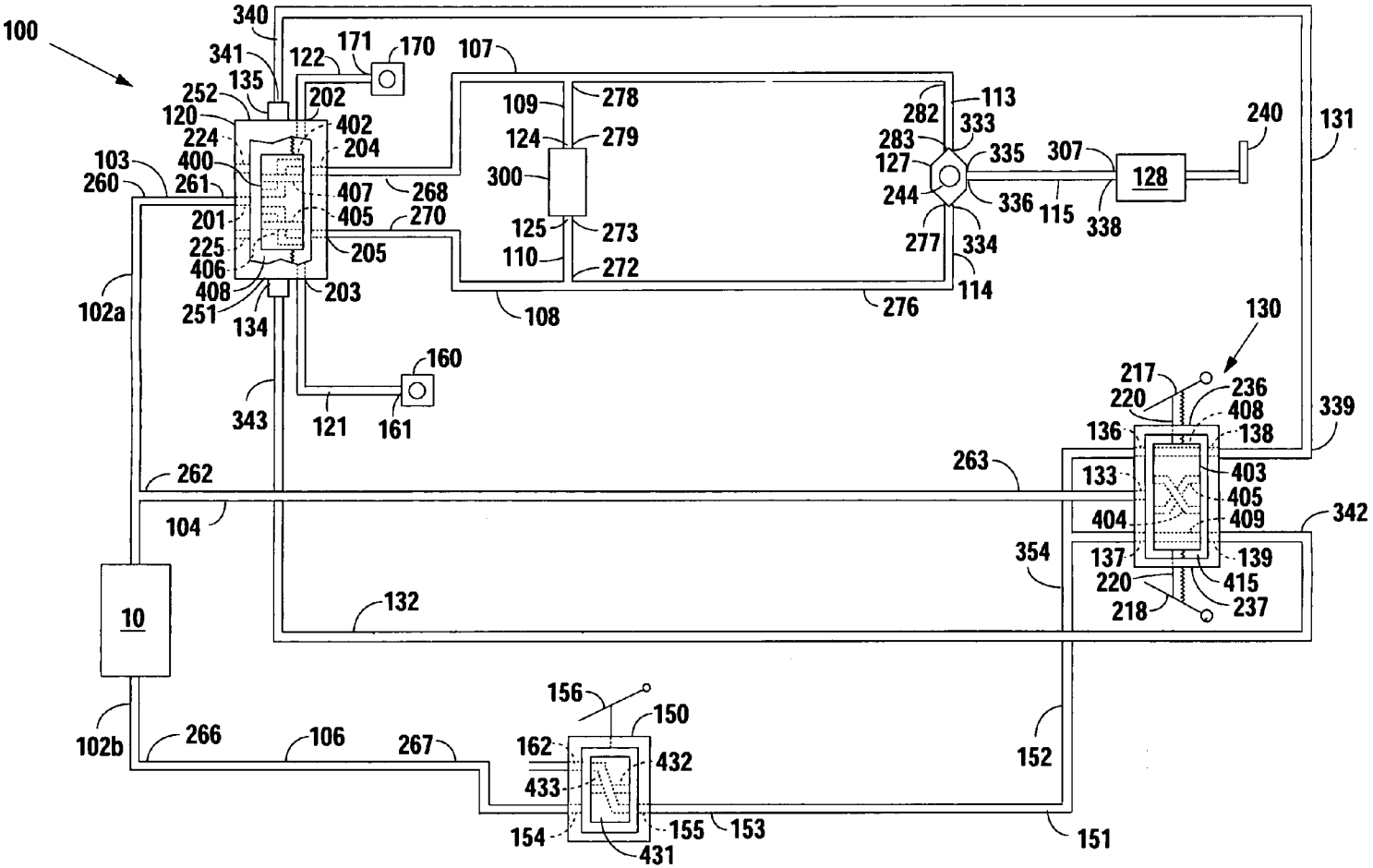
FIG. 4 is a block diagram illustrating a control system for a second embodiment.

As illustrated in FIG. 4, a second embodiment of the control system 100 is used to control a motor 300 for a hold to open and a hold to close a door regime. A hold to open, in this disclosure, is defined as a control system, wherein the movement of the door 350 is restricted to occurring when a button is depressed. The motor 300 is identical to the motor 300 as disclosed in the first embodiment, and like parts of the control system 100 have been labeled with like numerals. The control system 100 includes a main gas source 10, a first pilot valve 120, a second pilot valve 130, a shuttle check valve 127, and a cam operated valve 150. The first pilot valve 120 is a two position, double differential pilot valve with springs. As such, the valve 120 will return to a neutral or centered position when the button is released. The second pilot valve 130 is a two position, double pilot, spring centered, pressure pilot valve. The shuttle check valve 127 forces a higher pressure gas to pass through the shuttle check valve 127 to a brake release apparatus. The cam valve 150 is a manually opened valve used to stop the operation of the motor 300.

The control system 100 further includes a first return air cylinder 134, a second return air cylinder 135, and a brake air cylinder 128. The first return air cylinder 134 is coupled to the first pilot valve 120, such that it recenters a piston in the valve 120 from a first position associated with opening of the door. The second return air cylinder 135 is likewise coupled to the first pilot valve 120 to center the piston of the pilot valve 120, thereby going from a second position associated with closing the door to a neutral or centered position. The brake air cylinder 128 is used to release a brake 240 located in the gearbox 308 of the motor 300.

The control system 100 still further includes an open button 160, a close button 170, an open limit trigger 217, and a close limit trigger 218. The buttons are manually opened check valves. In a normal state, the pneumatic control system is pressurized. A continuously pressurized control system 100 allows for multiple activation buttons on a single pilot valve, and remote activation through an extended line. Once a bleeder button is activated, that particular side of a pilot valve is vented, thereby creating a pressure differential within the pilot valve. A piston in the pilot valve then shifts from the higher pressure side to the lower pressure side, thereby aligning passages to alternate pressure lines. The buttons, either remotely or directly mounted to the pilot valves, are used to activate operations including opening and closing of the door.

As shown in FIG. 4, the main gas source 10 of the control system 100 is connected to the lines 102*a* and 102*b*. The line 102*a* branches off to a first end 260 of a line 103 and a first end 262 of a line 104. The line 102*b* is coupled to a first end 266 of a line 106. A second end 261 of the line 103 is connected to a first inlet port 201 of the first pilot valve 120. The first pilot valve 120 includes the first inlet port 201, a second inlet port 224, a third inlet port 225, a first button port 202, a second button port 203, a first outlet port 204, and a second outlet port 205. The first button port 202 is connected to a line 122 that is, in turn, connected to an inlet port 171 of the close button 170. The buttons may be connected remotely or directly to the button ports. The second button port 203 is connected to a line 121 that is connected to an inlet port 161 of the open button 160, either remotely or directly. Lines 122 and 121 may represent passages within the first pilot valve 120 if the buttons 160 and 170 are directly connected to the first and second button ports 202 and 203 of the first pilot valve 120. The second inlet port 224 and the third inlet port 225 are open to atmosphere. A first end 268 of a line 107 is connected to the first outlet port 204.

Line 107 further branches off into a first end 278 of a line 109, a first end 280 and a first end 282 of a line 113. A first end 270 of a line 108 is connected to the second outlet port 205 and further branches off to a first end 272 of a line 110 and a first end 276 of a line 114.

The first return air cylinder 134 is attached to a first end 251 of a valve bore 401 of the first pilot valve 120 such that the piston 400 in the valve 120 is returned from a first or open position to a neutral position when the first return air cylinder 134 is pressurized. Similarly, the second return air cylinder 135 is attached to a second end 252 of the valve bore 401 such that the pilot valve 120 is returned from a second or close position when the second return air cylinder 135 is pressurized. The piston further includes two passages per position. An open position includes an "open" passage 402 and a "first exit" passage 405. A close position includes a "close" passage 406 and a "second exit" passage 407.

A second end 279 of the line 109 and a second end 273 of the line 110 connect to a first port 124 and a second port 125 of the motor 300, respectively. The first and second ports 124 and 125 are used as both inlets and outlets for gases, depending on the desired direction of rotation of the vanes in the motor 300.

A second end 283 of the line 113 attaches to a first port 333 of the shuttle check valve 127. A second end 277 of the line 114 attaches to a second port 334 of the shuttle check valve 127. A first end 336 of a line 115 attaches to a third port 335 of the shuttle check valve 127. The shuttle check valve 127 includes a shuttle 244 that moves away from a higher pressure. The line 115 connects the shuttle check valve 127 to the brake air cylinder 128. A second end 307 of the line 115 connects to an inlet port 338 of the brake air cylinder 128.

A second end 263 of the line 104 connects to a first inlet port 133 of the second pilot valve 130. The second pilot valve 130 is in communication with the close limit switch 218 and the open limit switch 217. The second pilot valve 130 includes a second inlet port 136, a third inlet port 137, a first outlet port 138, and a second outlet port 139. The first outlet port 138 is coupled to a first end 339 of a line 131. A second end 340 of the line 131 is coupled to an inlet port 341 of the first return air cylinder 134. The second outlet port 139 is coupled to a first end 342 of a line 132. A second end 343 of the line 132 is coupled to an inlet port 344 of the second return air cylinder 135.

The second pilot valve 130 further includes a bore 415 and a piston 403. The bore 415 includes a first end 236 and a second end 237. The piston includes two sets of passages, "pass through" passages 408 and 409 and "stop" passages 404 and 405.

A second end 267 of the line 106 is coupled to an inlet port 154 of the cam operated valve 150. A second port 155 of the cam operated valve 150 is coupled to a first end 153 of a line 151. A second end 152 of the line 151 is coupled to the second inlet port 136 and the third inlet port 137 of the second pilot valve 130. The cam operated valve 150 further includes an outlet port 162, an actuator 156 and a piston with an "exhaust" passage 433, and a "stop" passage 432. In this preferred embodiment, the actuator 156 is a manually operated handle.

In operation, the control system 100 is continuously pressurized, and is capable of opening and closing the door 350. While this embodiment is similar in construction to the first embodiment disclosed, the addition of return springs to the first pilot valve 120 forces the operator to hold the open button 160 or the close button 170 when operating the control system 100. The door 350 moves as long as one of the buttons is depressed. In this arrangement, a stop valve and a reversing function valve are no longer required for safe operation.

In an equilibrium state, the main air source 10 pressurizes the lines 102*a* and 102*b*, thereby pressuring the lines 103, 104, and 106. In a non-biased condition, the piston 400 of the first pilot valve 120 is located in the center of the bore 401. As there are no passages in the center of the piston 400, no air passes through the piston to the outlet ports 204 or 205 and the lines 107 and 108. If the open button 160 is depressed, the first end 408 of the valve bore 401 adjacent to the open button 160 loses pressure due to the venting by the open button 160, and the piston 400 is forced toward the open button end of the bore 401 by the pressure differential. In the shifted position, the "open" passage 402 lines up with the inlet port 201 and the first outlet port 204 to allow air into the line 107. As the line 107 is pressurized, the connected lines 109 and 113 are similarly pressurized.

Air in the line 113 pressurizes the first side of the shuttle check valve 127, thereby forcing the shuttle 244 to block the second port 334 of the shuttle check valve 127. The shuttle check valve 127 then builds pressure to further increase the flow of air through the motor 300. As the air pressure builds in the shuttle check valve 127, air is able to exit the shuttle check valve 127 through the third port 335, thereby entering line 115 and pressurizing the brake air cylinder 128 used as a brake 240 release. Pressurizing the brake air cylinder 128 releases the brake 240 in the gearbox 308 of the motor 300, so that the motor components are able to rotate when air flows through the motor 300. The brake 240 is normally spring loaded in the engaged position.

Air in the line 109 then enters the first port 124 of the motor 300 and forces the vanes to rotate, thereby rotating the motor driveshaft 351 and opening the door 350. The air passing through the motor 300 then exits the second port 125 of the motor and pressurizes the lines 110 and 108. As the air fills the line 108, it is forced to exit through the second outlet port 205 of the first pilot valve 120. Air entering the first pilot valve 120 through the second outlet port 205 then passes through the "first exit" passage 405 of the piston 400 and exits the third inlet port 225 of the first pilot valve 120. As such, the air passing through the motor 300 is unrestricted and the motor 300 will continue to open the door 350 until the open button 160 is released or the opening limit switch 217 is activated. If the open button 160 is released, the piston 400 in the first pilot valve 120 will return to the neutral or centered position by a spring.

Once the door fully opens, the open limit trigger 217 depresses the limit lever 220, thereby moving the piston 403 in the second pilot valve 130 out of a non-biased position. Normally, the piston 403 is centered with spring returns, such that no air is able to pass from the line 104 to the outlet ports 138 and 139. When the limit lever 220 is depressed, the piston 403 is forced from the centered position to a position aligning the inlet port 133 with the "stop" passage 404. As such, pressurized air from the line 104 passes through the inlet port 133, through the "stop" passage 404 in the piston 403, and through the outlet port 139 to the line 132. Since the line 132 is connected to the first return air cylinder 134, the first return air cylinder 134 is also pressurized. The first return air cylinder 134 extends to move the piston 400 of the first pilot valve 120 back to a centered position, thereby shutting off the air flow through the first pilot valve 120 to the motor 300. Accordingly, the motor 300 no longer rotates the second driveshaft 312 and the door 350 stops opening. The second pilot valve 130 remains in the shifted position as long as the door 350 is at the ends of its travel, however, the piston 400 in the first pilot valve 120 is free to move to close the door 350.

In the equilibrium state, the lines 102*a* and 103 are pressurized by the main air source 10, and the piston is in a non-biased condition, substantially centered in the bore of the first pilot valve 120. As there are no passages in the center of the piston, no air passes through the piston to the outlet ports 204 and 205 or the lines 107 and 108. If the close button 170 is depressed in this condition, the second end 252 of the valve bore loses pressure due to the venting by the close button 170, and the piston is forced towards the second end 252 by the pressure differential. In the shifted position, the "close" passage lines up with the inlet port 201 and the second outlet port 205 to allow air into the line 108. As the line 108 is pressurized, the connected lines 110 and 114 are also pressurized, thereby forcing the shuttle 244 in the shuttle check valve 127 to block the first port 333, therein pressurizing the line 115 and thus the brake air cylinder 128 to effect the release of the brake 240 as previously disclosed.

Air in the line 110 then enters the second port 125 of the motor 300 and forces the vanes to rotate, thereby rotating the motor driveshaft 351 and closing the door 350. The air passing through the motor 300 then exits the first port 124 and pressurizes the lines 109 and 107. As the air fills the line 107, it is forced to exit through the first outlet port 204 of the first pilot valve 120. Air entering through the first pilot valve 120 through the first outlet port 204 then passes through the "second exit" passage 407 of the piston 400 and exits the second inlet port 224 of the first pilot valve 120. As such, the air passing through the motor 300 is unrestricted and the motor will continue to close the door 350 until the close button 170 is released or the close limit trigger 218 is activated. If the close button 170 is released, the piston 400 in the first pilot valve 120 is moved to the neutral or centered position by the springs.

Once the door 350 fully closes, the close limit trigger 218 depresses the limit lever 220, thereby moving the piston 403 in the second pilot valve 130 out of a non-biased position. Normally, the piston 403 is centered with spring returns, such that no air is able to pass from the line 104 to the outlet ports 138 and 139. When the limit switch lever 220 is depressed, the piston 403 is forced from the centered position to a position aligning the inlet port 133 with the "stop" passage 405. As such, pressurized air from the line 104 passes through the inlet port 133, through the "stop" passage 405 in the piston 403, and through the outlet port 138 to the line 131. Since the line 131 is connected to the second return air cylinder 135, the second return air cylinder 135 is also pressurized. The second return air cylinder 135 extends and moves the piston 400 of the first pilot valve 120 back to a centered position. The flow of air through the first pilot valve 120 is now shut off. Accordingly, the motor 300 no longer rotates and the door 350 stops closing. The second pilot valve 130 remains in the shifted position as long as the door 350 is at the ends of its travel, however, the piston 400 in the first pilot valve 120 is free to move to open the door 350.

The control system 100 further includes a manual override circuit. The manual override circuit allows an operator to manually depress the cam-operated valve 150 to stop the motor 300, and pull a cable to release the brake. This particular segment of the control system is fed off of the line 106. In this preferred embodiment, the line 106 is substantially continuously pressurized by the main air source. However, the cam operated valve 150 does not allow the pressurized air to enter the system in the normal position.

In the normal position, the piston 431 in the cam operated valve 150 is situated such that it allows air to pass from the second port 155, through the "exhaust" passage 433 to the outlet port 162. As such, the line 151 serves as an exhaust line for the control system 100. When the actuator 156 is depressed, the piston 431 is shifted such that the "stop" passage 432 is aligned with the first port 154 and the second port 155, therein pressurizing the line 151. The pressurized air continues through the system; illustratively through the second pilot valve 130 to the lines 131 and 132, and the first and second return air cylinders 134 and 135. As the first and second return air cylinders 134 and 135 are pressurized, the piston of the first pilot valve 120 is returned to the centered position, thereby ceasing the flow of pressurized gas to the motor 300.

At this point, the operator may release the brake 240 by pulling a cable. Once the brake 240 is released, the operator may manually reposition the door. Once manual operations are completed, the actuator 156 may be moved to the normal position, and the brake 240 may be reengaged.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A door operator, comprising:

a pneumatic gas source;

a pneumatic motor coupled to a door;

a first pilot valve in fluid communication between the pneumatic gas source and the pneumatic motor, wherein the first pilot valve rests in a neutral position that does not allow the passage of gas from the gas source to the pneumatic motor, thereby maintaining the pneumatic motor unactuated; and a first check valve and a second check valve in fluid communication with the first pilot valve, wherein the pneumatic gas source delivers gas to the first pilot valve to maintain the first pilot valve in the neutral position, further wherein actuating one of the first check valve and the second check valve vents gas from the first pilot valve facilitating shifting of the first pilot valve to a respective one of a first position and a second position each of which allows the passage of gas from the pneumatic gas source through the first pilot valve and to the pneumatic motor, thereby actuating the motor and moving the door.

2. The door operator according to claim 1, further comprising:

a brake air cylinder coupled to a brake; and a shuttle check valve in communication with first and second ports of the motor and the brake air cylinder, wherein delivery of gas to the motor causes the shuttle check valve to open and deliver gas to the brake air cylinder, thereby causing the brake air cylinder to release the brake.

3. The door operator according to claim 2, wherein the brake is in communication with a driveshaft of the motor.

4. The door operator according to claim 1, further comprising:

a second pilot valve in communication with the pneumatic gas source;

a limit trigger in communication with the second pilot valve, wherein the limit trigger is activated upon the door reaching a fully opened position; and a first return air cylinder coupled to the first pilot valve and in fluid communication with the second pilot valve, wherein the limit trigger moves the second pilot valve to a position that allows the passage of gas from the pneumatic gas source through the second pilot valve and to the first return air cylinder, thereby moving the first pilot valve to the neutral position.

5. The door operator according to claim 4, further comprising:

a second return air cylinder coupled to the first pilot valve and in fluid communication with the second pilot valve;

a third pilot valve in communication with the pneumatic gas source and the second pilot valve, the third pilot valve rests in a neutral position that does not allow the passage of gas from the pneumatic gas source therethrough; and a third check valve in fluid communication with the third pilot valve, wherein, when the third check valve is vented, the third pilot valve is shifted to a position that allows gas to flow from the pneumatic gas source through the third and second pilot valves and to the first and second return air cylinders, thereby moving the first pilot valve to the neutral position.

6. The door operator according to claim 5, wherein the third pilot valve includes a third return air cylinder.

7. The door operator according to claim 5, further comprising:

a cam-operated valve in fluid communication with the pneumatic gas source and the third pilot valve;

an actuator disposed on the cam-operated valve, wherein when the actuator is actuated gas from the pneumatic gas source passes through the cam-operated valve, through the third pilot valve, through the second pilot valve, and to the first and second return air cylinders, thereby moving the first pilot valve to the neutral position.

8. The door operator according to claim 7, further comprising:

a door release mechanism, wherein the door may be manually moved when the release mechanism is activated.

9. The door operator according to claim 8, wherein the release mechanism is a cable.

10. The door operator according to claim 1, further comprising:

wherein actuating the second check valve actuates the motor to lower the door.

11. The door operator according to claim 10, further comprising:

a brake air cylinder coupled to a brake; and a shuttle check valve in communication with first and second ports of the motor and the brake air cylinder, wherein delivery of gas to the motor causes the shuttle check valve to open and deliver gas to the brake air cylinder, thereby causing the brake air cylinder to release the brake.

12. The door operator according to claim 11, wherein the brake is in communication with a driveshaft of the motor.

13. The door operator according to claim 11, further comprising:

a fourth pilot valve in fluid communication with first and second ports of the motor and the first check valve; and a biasing mechanism disposed in the fourth pilot valve, wherein, when the door is closing, the fourth pilot valve vents the first check valve once a pressure differential between the first and second ports of the motor overcomes the biasing force of biasing mechanism thereby causing the door to open.

14. The door operator according to claim 13, wherein a pressure differential that overcomes the biasing force occurs when the door encounters an object when closing.

15. The door operator according to claim 1, further comprising:

a third check valve in fluid communication with the first check valve, wherein, when the third manual check valve is vented, the first pilot valve moves to the first position that allows gas from the pneumatic gas source to move through the first pilot valve to the motor to open the door.

16. The door operator according to claim 15, wherein the second check valve is located remote from the first check valve.

17. The door operator according to claim 16, wherein the second check valve is located on a leading edge of the door.

18. The door operator according to claim 17, further comprising:

a limiter valve in fluid communication between the first check valve and the third check valve, wherein the limiter valve is activated immediately prior to the door fully closing.

19. The door operator according to claim 18, wherein gas from the pneumatic gas source does not flow to the third check valve when the limiter valve is activated.

20. The door operator according to claim 19, wherein the limiter valve is deactivated when the door is open.

21. The door operator according to claim 1, wherein the first pilot valve includes a biasing return mechanism that maintains the first pilot valve in the neutral position when the door operator is not vented.

22. The door operator according to claim 21, further comprising:

a cam-operated valve in fluid communication with the pneumatic gas source and a second pilot valve; and an actuator disposed on the cam-operated valve, wherein gas from the pneumatic gas source passes through the cam-operated valve and the second pilot valve to first and second return air cylinders which return the first pilot valve to the neutral position when the actuator is operated.

23. The door operator according to claim 21, wherein pressing and holding the first check valve vents the first check valve which causes the first pilot valve to shift to and remain in the first position which allows the passage of gas from the pneumatic gas source to the pneumatic motor, thereby actuating the motor and raising the door.

24. The door operator according to claim 21, wherein the biasing return mechanism includes a spring.

* * * * *